US011254398B2

(12) United States Patent
Xiao et al.

(10) Patent No.: US 11,254,398 B2
(45) Date of Patent: Feb. 22, 2022

(54) POROUS-STRUCTURE DEVICE FOR SUPPRESSING WAVE RUN-UP AND DESIGN METHOD THEREOF

(71) Applicant: SHANGHAI JIAO TONG UNIVERSITY, Shanghai (CN)

(72) Inventors: Longfei Xiao, Shanghai (CN); Zhichao Fang, Shanghai (CN); Haobo Li, Shanghai (CN); Yufeng Kou, Shanghai (CN); Mingyue Liu, Shanghai (CN); Handi Wei, Shanghai (CN); Guocheng Zhao, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 38 days.

(21) Appl. No.: 16/934,037

(22) Filed: Jul. 21, 2020

(65) Prior Publication Data

US 2020/0346722 A1 Nov. 5, 2020

Related U.S. Application Data

(63) Continuation of application No. PCT/CN2019/084157, filed on Apr. 24, 2019.

(30) Foreign Application Priority Data

Aug. 1, 2018 (CN) ..... 201810863599.X

(51) Int. Cl.
*B63B 35/44* (2006.01)
*B63B 17/00* (2006.01)

(52) U.S. Cl.
CPC ..... *B63B 35/44* (2013.01); *B63B 2017/009* (2013.01); *B63B 2035/442* (2013.01)

(58) Field of Classification Search
CPC ... B63B 35/00; B63B 35/44; B63B 2017/009; B63B 2035/442; B63B 9/00; B63B 9/02; B63B 39/00; B63B 39/03
(Continued)

(56) References Cited

U.S. PATENT DOCUMENTS 3,299,846 A * 1/1967 Jarlan ..... B63B 35/4413 114/264
4,232,623 A 11/1980 Chou et al.
(Continued)

FOREIGN PATENT DOCUMENTS

CN 104743075 7/2015
CN 104802948 7/2015
(Continued)

*Primary Examiner* — Lars A Olson
(74) *Attorney, Agent, or Firm* — JCIP Global Inc.

(57) ABSTRACT

A porous-structure device includes a semi-submersible platform consisting of four columns, two pontoons, two horizontal supports and a deck. Fillets on middle portions of the columns have a square section, a radius of the fillets, close to the deck and the pontoons, of the columns is gradually decreased to 0, a porous device is disposed outside each column and is formed by combining and connecting four single components, and each single component is formed by combining and connecting a plurality of porous laminated plates and a plurality of connecting pieces. The parameters, such as the pore type, porosity, number of layers, interlayer spacing and installation height, of the porous laminated plates are set according to the wave characteristics in different sea areas.

8 Claims, 5 Drawing Sheets

(58) Field of Classification Search
USPC ..... 114/264, 265, 266, 267
See application file for complete search history.

(56) References Cited

U.S. PATENT DOCUMENTS

| | | | | |
|---|---|---|---|---|
| 4,233,924 | A | 11/1980 | Clinton | |
| 6,089,175 | A * | 7/2000 | Toki | B63B 39/10 114/264 |
| 6,102,625 | A * | 8/2000 | Olsen | B63B 39/005 114/264 |
| 6,408,780 | B1 * | 6/2002 | Ozaki | B63B 39/10 114/264 |
| 8,418,640 | B2 * | 4/2013 | Leverette | B63B 35/4413 114/264 |

FOREIGN PATENT DOCUMENTS

| | | |
|---|---|---|
| CN | 206900602 | 1/2018 |
| CN | 109080781 | 12/2018 |
| CN | 208602661 | 3/2019 |

* cited by examiner aaaaa

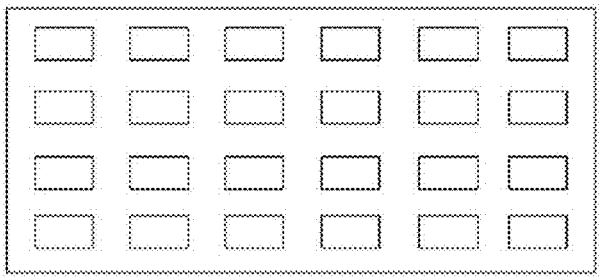
FIG. 6
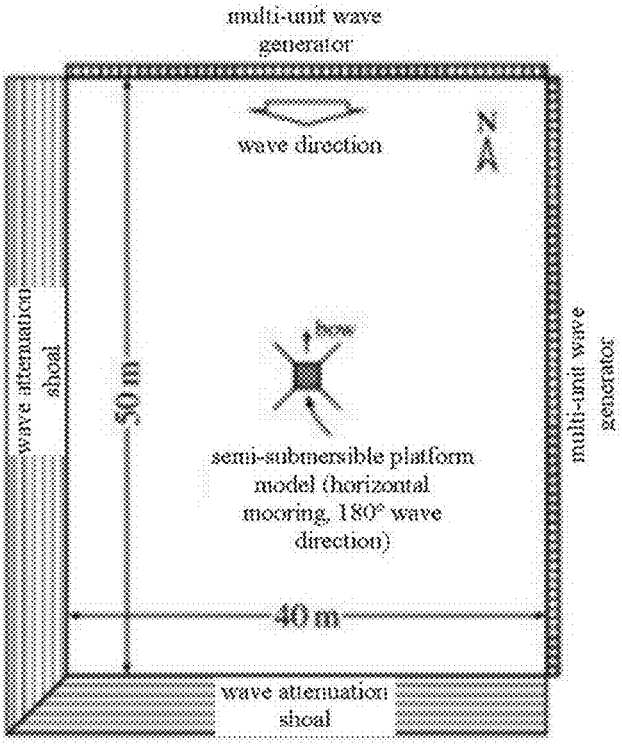
FIG. 7
| | real value (m) | model value (mm) |
|---|---|---|
| overall length*width*depth | 124.21×89×45.3 | 2070×1483×755 |
| length*width*height of column | 19.25×18.5×36.525 ( R4.5 ) | 321×308×417 ( R75 ) |
| bottom height of lower deck | 36.5 | 608 |
FIG. 8

| | unit | real value | model value |
|---|---|---|---|
| Draft | m | 19.5 | 0.3250 |
| Initial air gap | m | 17.0 | 0.2833 |
| Displacement | MT | 69410.8 | 0.3135 |
| Height of center of gravity | m | 30.528 | 0.5088 |
| $GM_T$ | m | 1.249 | 0.0208 |
| $GM_L$ | m | 1.292 | 0.0215 |
| Horizontal inertia radius [1] | m | 34.985 | 0.5831 |
| Longitudinal inertia radius [1] | m | 36.489 | 0.6081 |
| vertical inertia radius [1] | m | 39.344 | 0.6557 |
| natural heaving period | s | 21.75 | 2.81 |
| natural rolling period | s | 97.30 | 12.56 |
| natural pitching period | s | 89.30 | 11.53 |

[1] relative to the platform center

FIG. 9

| Serial number | $T_p$ | $H_s$ | $\gamma$ | Description |
|---|---|---|---|---|
| IRR1 | 16.10 | 13.80 | 2.4 | Once-in-a-century wave environment in Hainan |
| IRR2 | 15.40 | 15.80 | 2.5 | Once-in-a-century wave environment in Gulf of Mexico |
| IRR3 | 10.56 | 9.60 | 5.0 | Maximum acceleration condition |
| IRR4 | 11.18 | 10.42 | 5.0 | Minimum air gap condition |
| IRR5 | 15.90 | 16.90 | 2.4 | Once-in-a-millennium wave environment in Gulf of Mexico |

FIG. 10

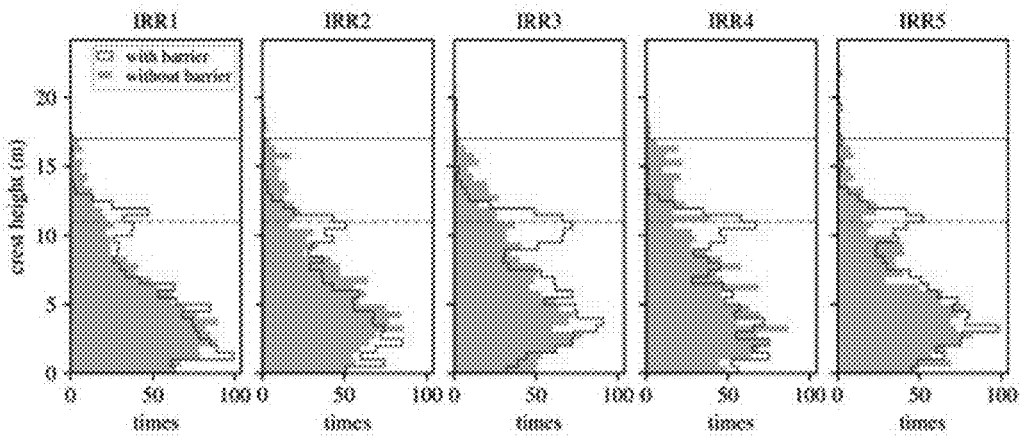

FIG. 11

POROUS-STRUCTURE DEVICE FOR SUPPRESSING WAVE RUN-UP AND DESIGN METHOD THEREOF

CROSS-REFERENCE TO RELATED APPLICATION

This application is a continuation of international application of PCT application serial no. PCT/CN2019/084157 filed on Apr. 24, 2019, which claims the priority benefit of China application no. 201810863599.X filed on Aug. 1, 2018. The entirety of each of the above mentioned patent applications is hereby incorporated by reference herein and made a part of this specification.

BACKGROUND

Technical Field

The invention relates to the technical field of marine equipment, in particular to a porous-structure device for suppressing wave run-up and a design method thereof.

Description of Related Art

Wave run-up around columns is a big problem encountered in design and operation of large marine structures. Since marine platforms with large-diameter columns, such as semi-submersible platforms, have remarkable non-linear characteristics when interacting with waves, in addition to wave run-up, caused under the dual action of wave diffraction and wave radiation, around the columns, jet flows are often formed on the surfaces of the columns by waves, so the risk that the lower deck is impacted by waves and even the waves rush onto the deck is increased, thus threatening the safety of the marine platforms. In recent years, equipment damage and even safety accidents resulting from wave run-up under severe sea conditions occur frequently and have arouse the attention of the industrial community and the academic community to wave run-up around the columns and problems about the pores of the marine platforms.

Existing technologies cannot solve the problem of wave run-up of the marine platforms for the reason that a common measure for improving the pore performance of the marine platforms by increasing the height of the deck or by changing the appearance of the platforms will be restricted by the weight, stability and engineering cost of the platforms.

Hence, it is necessary to improve such structure to overcome the above-mentioned defects.

SUMMARY

The objective of the invention is to provide a porous-structure device for suppressing wave run-up and a design method thereof. According to the porous-structure device for suppressing wave run-up and the design method thereof, the form, number of layers, interlayer spacing, installation height and porosity of porous structures additionally arranged on columns of a marine platform are designed to realize the effect of suppressing wave run-up and to minimize the influence on the original hydrodynamic performance of the marine platform.

The technical solution adopted by the invention to solve the technical problems is as follows.

A porous-structure device for suppressing wave run-up comprises a marine platform consisting of four columns, two pontoons, four horizontal supports and a deck. Fillets on middle portions of the columns have a square section, and a radius of the fillets, close to the deck and the pontoons, of the columns is gradually decreased to 0. Two sliding grooves are concavely and vertically formed in each of the four sides of each column, connecting blocks are slidably arranged in the sliding grooves, and the connecting blocks can be changed to adjust a height of the porous-structure device. A porous device is disposed outside each column and is formed by combining and connecting four single components, and each single component is a single multi-layer porous structure formed by combining and connecting a plurality of porous laminated plates and a plurality of connecting pieces. A plurality of through holes penetrate through the surfaces of the porous laminated plates, the plurality of porous laminated plates are arranged in parallel, 45° internal unfilled corners are formed at the ends of two sides of each porous laminated plate, and the four single components are arrayed in a square shape to form the porous device and are disposed on the outer surface of the column.

Preferably, the porous laminated plates and the connecting pieces are all made of steel.

Preferably, the porous laminated plates are of a plate-like structure, the connecting pieces are of a strip-shaped structure, and the plurality of connecting pieces are welded between every two adjacent porous laminated plates.

Preferably, fixing plates are connected to the upper ends of the single components through the connecting pieces, and each fixing plate has two first screwed-connection holes penetrating through the fixing plate. Two connecting lugs protrude on each of the four sides of the top of each column, each connecting lug has a second screwed-connection hole penetrating therethrough, and each connecting block has a third screwed-connection hole penetrating therethrough. The first screwed-connection holes, the second screwed-connection holes and the third screwed-connection holes are mutually matched. The connecting lugs, the connecting blocks and the fixing plates are fastened with bolts to ensure that the porous-structure device is fixed at high positions of the columns and is located below the deck.

Preferably, inner walls of the first screwed-connection holes, the second screwed-connection holes and the third screwed-connection holes are of a threaded structure.

Preferably, adapter plates are welded to the ends of the inner sides of the porous laminated plates of the single components, and the adapter plates are triangular and have arc notches matched with the fillets of the columns.

A design method of the porous-structure device for suppressing wave run-up comprises the following steps.

S1: Brief summary of test preparations. Preparing a water pool having a length of 50 m, a width of 40 m and a depth of 10 m and configured with a liftable false bottom to simulate any water depths from 0 m to 9.8 m for a test. Two multi-unit wave generation systems are separately configured on two sides of the water pool, and a ship-type semi-submersible platform including four columns, two pontoons and a box-like deck is used as a test model, wherein fillets on middle portions of the columns have a square section, and a radius of the fillets close to the deck and the pontoons is gradually decreased to 0.

S2: Comprehensively considering all factors such as the sizes of the semi-submersible platform, the dimensions of a marine engineering deep pool, a simulation capacity of a marine environment and a measuring range of measurement instruments used in the test, determining a scale ratio 2 (real value:model value) of the model adopted in the test to be 60, comparing and analyzing a pore performance of the platform before installation of the additional porous structures on the columns and a pore performance of the platform after installation of the additional porous structures on the columns in five wave environments, and then determining parameters of the porous structures.

S3: Designing the sizes of the porous structures based on the platform. According to a draft of the platform, a height of the columns and a height of a lower deck, determining a total number of the porous laminated plates to be 10, an interlayer spacing (distance between theoretical lines) between the porous laminated plates to be 0.6 m, a distance from an installation height of a bottommost porous laminated plate to a baseline to be 30.5 m, and a distance from a topmost porous laminated plate to the lower deck to be 0.6 m. Sizes of corresponding models are as follows: the interlayer spacing is 10 mm, and the distance from the topmost porous laminated plate to the lower deck is 10 mm. Under a survival load condition, the distance from the bottom surfaces of the additional porous structures to a calm water line is 11 m, so that interaction with waves is basically avoided, and a hydrodynamic performance of the platform in normal operation will not be affected. A thickness value of the additional porous structures on the columns is 10% of the width of the columns, and comprehensively considering a height and thickness distribution of typical run-up water jets along the columns, 10% of the width of the columns of the platform model is 1.825 m. As for a four-column gravity-type platform, a typical thickness of wave run-up water flows along surfaces of the columns close to the lower deck is about 1 m-1.5 m. Under the comprehensive considerations, the thickness of the additional porous structures on the columns is set to 1.5 m, and a corresponding model value is 25 mm.

S4: Determining parameters of the porous laminated plates. Comprehensively considering a machining process of the additional structure models, material strength and porosity, and setting a dimension of pores is finally set to 5.5 mm*3.5 mm. An edge spacing between the pores in a width direction is 2 mm. In a thickness direction, the pores are arrayed in four rows, an edge spacing between the pores is 2.2 mm, and an overall porosity is about 41.1%.

Compared with the prior art, the invention has the following advantages.

1. According to the invention, the special porous structures are designed and selected with the wave run-up suppression effect as the standard, so that wave run-up is effectively suppressed, and the problems of wave run-up and wave impacts to the marine platform are solved.

2. The porous-structure device of the invention is easy to assemble and disassemble and can be disassembled and changed at any time in different sea areas or under different sea conditions. The parameters, such as the pore type, porosity, number of layers, interlayer spacing and installation height, of the porous laminated plates are set according to the wave characteristics in different sea areas, so that the wave run-up suppression effect of the device can be improved. The height of the porous structures can be adjusted by changing the length of the connecting blocks, so that the adjustability is greatly improved.

3. The thickness of the porous laminated plates is generally not over 10% of the width of the columns, and the device has many pores, thereby being smaller and lighter than marine platform and having little influence on the hydrodynamic characteristic of the marine platform.

4. The porous-structure device is mounted at high positions of the columns and is located below the deck, so that normal waves will not be affected, and only high wave run-up that may cause impact risks will be suppressed, and the normal hydrodynamic performance of the platform is slightly affected.

5. The porous-structure device of the invention is simple, effective, low in cost and high in practical value. A large transformation to the platform is avoided, the measures, for reducing waves rushing onto the deck by increasing the height of the columns or by increasing the height of the deck, that may affect the performance of the platform are avoided, and the solution is easy to operate and implement.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

FIG. 6 is a vertical view of a porous laminated plate.

FIG. 7 is an arrangement diagram of a water pool.

FIG. 8 is a principal dimension table of a model.

FIG. 9 is a weight parameter table of the model.

FIG. 10 is a parameter table of wave environments.

FIG. 11 is a diagram of test results.

DESCRIPTION OF THE EMBODIMENTS

To gain a better understanding of the technical means, creative features, purposes and effects of the invention, the invention is further expounded below in conjunction with the accompanying drawings and specific embodiments.

Figure 1:
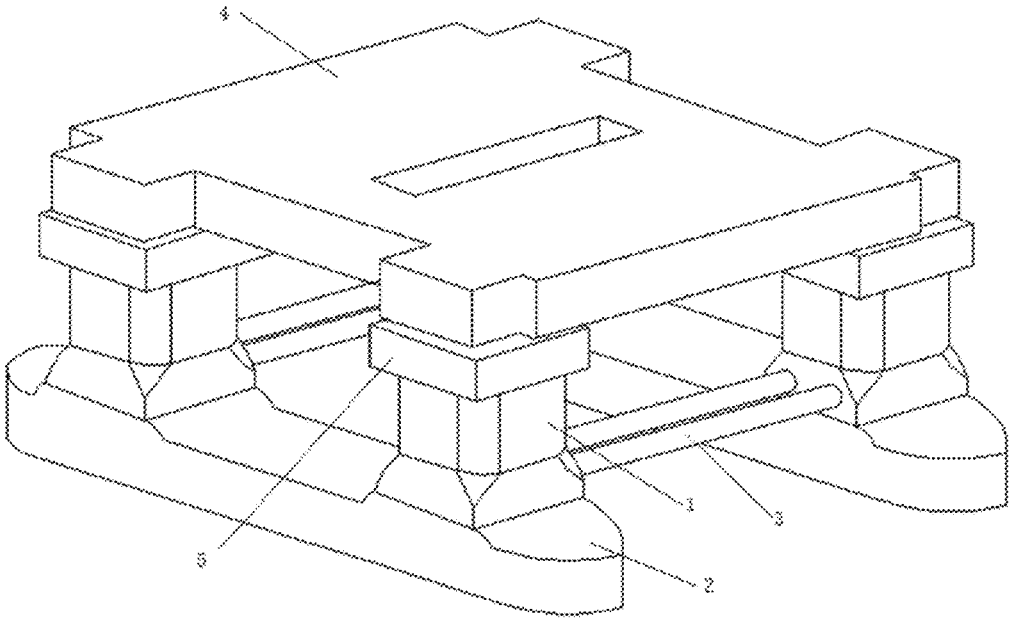
FIG. 1 is a structural diagram of a porous-structure device for suppressing wave run-up of the invention.
Figure 2:
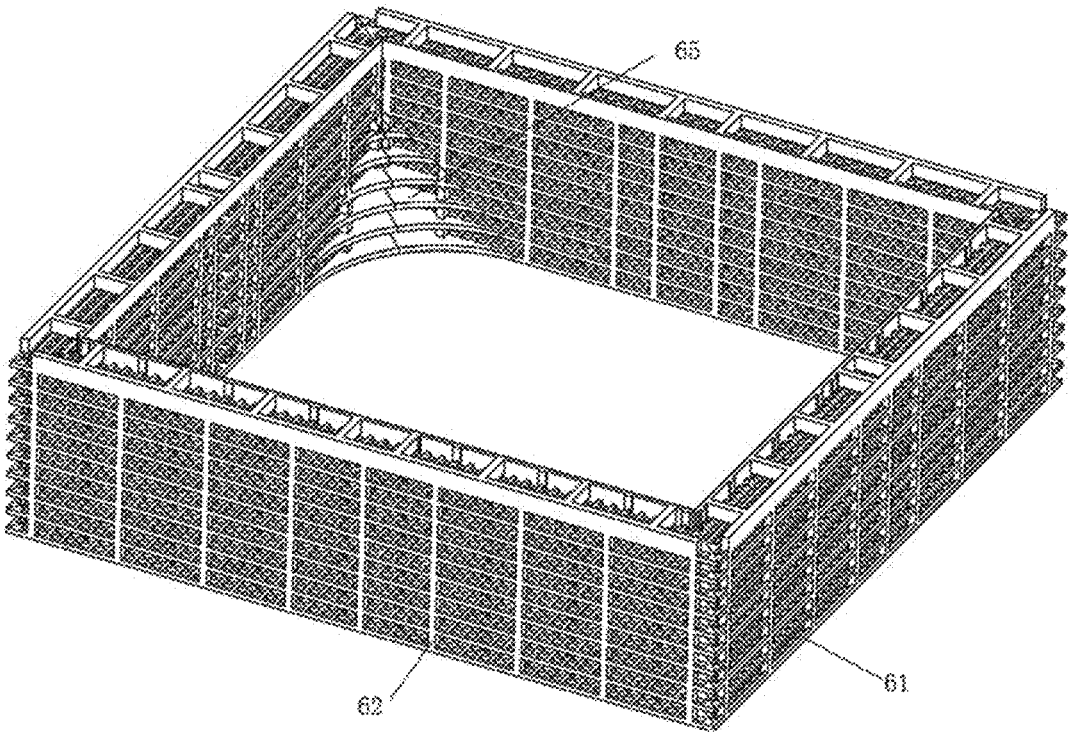
FIG. 2 is a structural diagram of a porous device.
Figure 3:
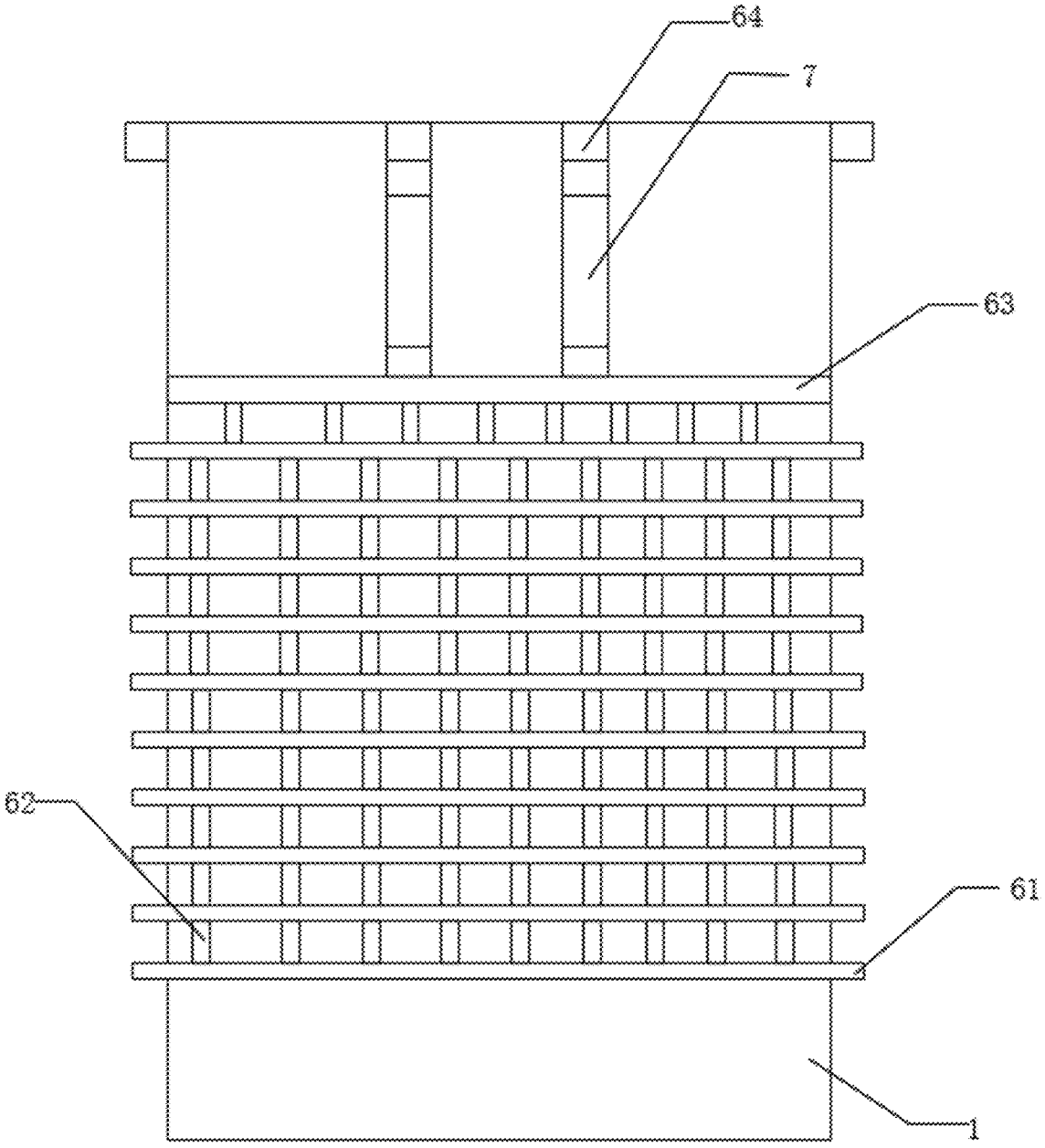
FIG. 3 is a structural diagram of the combination of a single component and a column.
Figure 4:
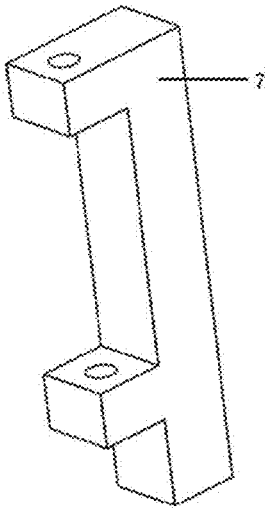
FIG. 4 is a structural diagram of a connecting block.
Figure 5:
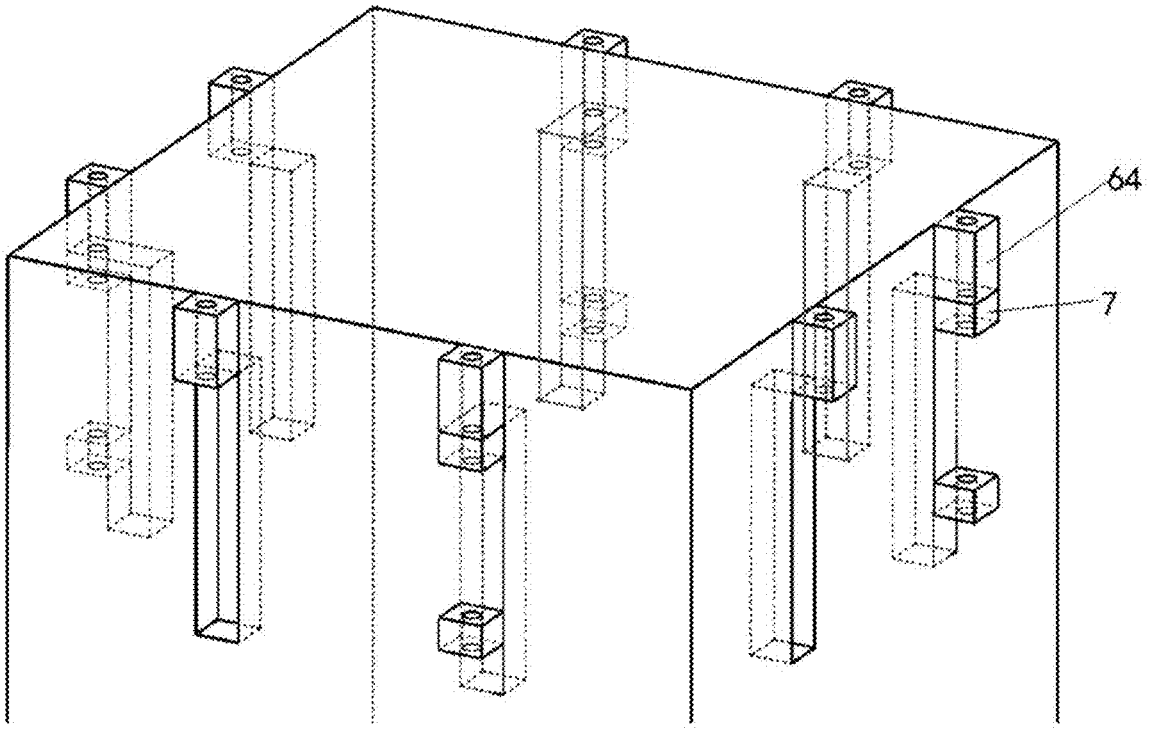
FIG. 5 is a positional relation diagram of connecting blocks disposed in sliding grooves and fixedly connected to connecting lugs.

As shown in FIG. 1 to FIG. 11, the invention provides a porous-structure device for suppressing wave run-up, which comprises a semi-submersible platform consisting of four columns 1, two pontoons 2, four horizontal supports 3 and a deck 4. Two columns 1 are fixed to the upper end of each pontoon 2, the deck 4 is fixed to the upper ends of the four columns 1, every two corresponding columns are fixed by means of two horizontal supports 3, fillets on middle portions of the columns 1 have a square section, and the radius of the fillets, close to the deck 4 and the pontoons 2, of the columns 1 is gradually decreased to 0. Two sliding grooves are concavely and vertically formed in each of the four sides of each column 1, sliding blocks 7 are slidably disposed in the sliding grooves, the sliding grooves are T-shaped sliding grooves, the connecting blocks 7 are of a square structure, sliding blocks are convexly arranged on the inner sides of the connecting blocks 7, and the sliding blocks are of a T-shaped structure and are matched with the sliding grooves.

A porous device 5 is disposed outside each column 1 and is formed by combining and connecting four single components, and each single component is formed by combining and connecting a plurality of porous laminated plates 61 and a plurality of connecting pieces 62.

A plurality of through holes penetrate through the surfaces of the porous laminated plates 61, the plurality of porous laminated plates 61 are arranged in parallel, and 45° internal unfilled corners are formed at the ends of two sides of each porous laminated plate 61. The four single components 6 are arrayed in a square shape to form the porous device 5 and are disposed outside the column 1.

Preferably, the porous laminated plates 61 and the connecting pieces 62 are all made of steel.

Preferably, the porous laminated plates 61 are of a plate-like structure, the connecting pieces 62 are of a strip-shaped structure, and the plurality of connecting pieces 62 are welded between every two adjacent porous laminated plates 61.

Preferably, fixing plates 63 are connected to the upper ends of the single components 6 through the connecting pieces 62, and two first screwed-connection holes penetrate through the surface of each fixing plate 63.

Two connecting lugs 64 protrude on each of the four sides of the top of each column 1, each connecting lug 64 has a second screwed-connection hole penetrating through the connecting lug 64, each connecting block 7 has a third screwed-connection hole penetrating through the connecting block 7, and the first screwed-connection holes, the second screwed-connection holes and the third screwed-connection holes are mutually matched. The connecting lugs 64, the connecting blocks 7 and the fixing plates 63 are fastened with bolts.

Preferably, the inner walls of the first screwed-connection holes, the second screwed-connection holes and the third screwed-connection holes are of a threaded structure.

Preferably, adapter plates 65 are welded to the ends of the inner sides of the porous laminated plates 61 of the single components 6, the adapter plates 65 are triangular and have arc notches matched with the fillets of the columns 1, and every two adjacent adapter plates are welded together.

A design method of the porous-structure device for suppressing wave run-up comprises the following steps.

S1: Brief summary of test preparations. A test water pool adopted for this design has a length of 50 m, a width of 40 m and a depth of 10 m and is configured with a liftable false bottom to simulate any water depths from 0 m to 9.8 m. Two multi-unit wave generation systems are separately configured on two sides of the water pool, and the arrangement of the water pool is shown in FIG. 7. A ship-type semi-submersible platform including four columns, two pontoons and a box-like deck is used as a test model, wherein fillets on middle portions of the columns have a square section, and the radius of the fillets close to the lower deck and the lower pontoons is gradually decreased to 0.

S2: Under comprehensive consideration of the factors such as the sizes of the semi-submersible platform, the dimensions of the marine engineering deep pool, the simulation capacity of a marine environment and the measuring range of measurement instruments used in this test, the scale ratio 2 (real value:model value) of the model adopted in this test is determined to be 60, and a principal dimension table and a weight parameter table of the model are separately shown by FIG. 8 and FIG. 9. In this test, the pore performance of the platform before installation of additional porous structures on the columns and the pore performance of the platform after installation of the additional porous structures on the columns in five wave environments are compared and analyzed, a parameter table of the porous structures is shown by FIG. 10, and test results are shown in FIG. 11, wherein the full line refers to the height of the lower deck, and the dotted line refers to the installation height of the porous structures.

S3: The sizes of the porous structures are designed based on the platform. According to the draft of the platform, the height of the columns and the height of the lower deck, the total number of the porous laminated plates is determined to be 10, the interlayer spacing (spacing between theoretical lines) is 0.6 m, the distance from the installation height of the bottommost porous laminated plate to a baseline is 30.5 m, and the distance from the topmost porous laminated plate to the lower deck is 0.6 m. The sizes of corresponding models are as follows: the interlayer spacing is 10 mm, and the distance from the topmost porous laminated plate to the lower deck is 10 mm. Under a survival load condition, the distance from the bottom surfaces of the additional porous structures to a calm water line is 11 m, so that the interaction with waves is basically avoided, and the hydrodynamic performance of the platform in normal operation will not be affected. The thickness of the additional porous structures on the columns may be 10% of the width of the columns, and under comprehensive consideration of the height and thickness distribution of typical run-up water jets along the columns, 10% of the width of the columns of the platform model is 1.825 m. Moreover, as for a four-column gravity-type platform, the typical thickness of wave run-up water flows along the surfaces of the columns close to the lower deck is about 1 m-1.5 m. Under the abovementioned comprehensive consideration of these two points, the thickness of the additional porous structures on the columns is set to 1.5 m, and a corresponding model value is 25 mm. As shown in FIG. 6 which illustrates arrangement details of pores in the laminated plates of the additional porous structures, under comprehensive consideration of many factors such as the machining process of the additional structure models, material strength and porosity, the dimension of the pores is finally set to 5.5 mm*3.5 mm, and the edge spacing between the pores in a width direction is 2 mm. In a thickness direction, the pores are arrayed in four rows, the edge spacing between the pores is 2.2 mm, and the overall porosity is about 41.1%.

In a preferred embodiment, each single component comprises 10 porous laminated plates, the interlayer spacing between the porous laminated plates is 0.6 m, the distance from the installation height of the bottommost porous laminated plate to the baseline is 30.5 m, the distance from the topmost porous laminated plate to the deck is 0.6 m, and the distance from the bottom surfaces of the porous devices to the calm water line is 11 m. According to the fact that the typical thickness of column run-up water flows close to the deck is 1 m-1.5 m, and the thickness of the porous laminated plates is determined to be 1.5 m. The dimension of the pores of the porous laminated plates is 5.5 mm*3.5 mm, and the edge spacing between the pores in the width direction is 2 mm. In the thickness direction, the pores are arrayed in four rows, and the edge spacing between the pores is 2.2 mm.

The basic principle, principal characteristics and advantages of the invention are illustrated and described above. Those skilled in the art would appreciate that the invention is not limited to the above embodiments, the above embodiments and the description in the specification are merely for explaining the principle of the invention, and different transformations and improvements made to the invention without departing from the spirit and scope of the invention should also fall within the protection scope of the invention. The protection scope of the invention is defined by the appended claims and equivalents thereof.

What is claimed is:

1. A porous-structure device for suppressing wave run-up, the porous-structure device comprising a marine platform consisting of four columns, two pontoons, four horizontal supports and a deck, wherein fillets on middle portions of the columns have a square section, and a radius of the fillets, close to the deck and the pontoons, of the columns is gradually decreased to 0; two sliding grooves are concavely and vertically formed in each of four sides of each of the columns, and connecting blocks are slidably arranged in the sliding grooves;

a porous device is disposed outside each of the columns and is formed by combining and connecting four single components, and each of the single components is formed by combining and connecting a plurality of porous laminated plates and a plurality of connecting pieces; and a plurality of through holes penetrate through surfaces of the porous laminated plates, the plurality of porous laminated plates are arranged in parallel, 45° internal unfilled corners are formed at ends of two sides of each of the porous laminated plates, and the four single components are arrayed in a square shape to form the porous device and are disposed outside each of the columns.

2. The porous-structure device for suppressing wave run-up according to claim 1, wherein the marine platform is a semi-submersible platform.

3. The porous-structure device for suppressing wave run-up according to claim 1, wherein the porous laminated plates and the connecting pieces are all made of steel.

4. The porous-structure device for suppressing wave run-up according to claim 1, wherein the connecting pieces are of a strip-shaped structure, and the plurality of connecting pieces are welded between every two adjacent of the porous laminated plates.

5. The porous-structure device for suppressing wave run-up according to claim 1, wherein fixing plates are connected to upper ends of the single components through the connecting pieces, and each of the fixing plates has two first screwed-connection holes penetrating therethrough; and two connecting lugs protrude on each of four sides of a top portion of each of the columns, each of the connecting lugs has a second screwed-connection hole penetrating therethrough, and each of the connecting blocks has a third screwed-connection hole penetrating therethrough; the first screwed-connection holes, the second screwed-connection holes and the third screwed-connection holes are mutually matched; and the connecting lugs, the connecting blocks and the fixing plates are fastened with bolts to ensure that the porous-structure device is fixed at the columns and is located below the deck.

6. The porous-structure device for suppressing wave run-up according to claim 4, wherein inner walls of the first screwed-connection holes, the second screwed-connection holes and the third screwed-connection holes are of a threaded structure.

7. The porous-structure device for suppressing wave run-up according to claim 1, wherein adapter plates are welded to ends of inner sides of the porous laminated plates of the single components, and the adapter plates are triangular and have arc notches matched with the fillets of the columns.

8. A design method of the porous-structure device for suppressing wave run-up according to claim 1, the design method comprising the following steps:

S1: brief summary of test preparations, wherein the preparation includes preparing a water pool having a length of 50 m, a width of 40 m and a depth of 10 m and configured with a liftable false bottom to simulate any water depths from 0 m to 9.8 m for a test, wherein two multi-unit wave generation systems are separately configured on two sides of the water pool, and a ship-type semi-submersible platform including four columns, two pontoons and a deck is used as a test model, wherein fillets on middle portions of the columns have a square section, and a radius of the fillets close to the deck and the pontoons is gradually decreased to 0;

S2: comprehensively considering all factors comprising sizes of the semi-submersible platform, dimensions of a marine engineering deep pool, a simulation capacity of a marine environment and a measuring range of measurement instruments used in the test, determining a scale ratio $\lambda$ of the model adopted in the test to be 60, comparing and analyzing a pore performance of the platform before installation of additional porous structures on the columns and a pore performance of the platform after installation of the additional porous structures on the columns in five wave environments, and then determining parameters of the porous structures;

S3: designing sizes of the porous structures based on the platform, wherein the designing includes according to a draft of the platform, a height of the columns and a height of a lower deck, determining a total number of the porous laminated plates to be 10, an interlayer spacing between the porous laminated plates to be 0.6 m, a distance from an installation height of a bottom-most porous laminated plate to a baseline to be 30.5 m, and a distance from a topmost porous laminated plate to the lower deck to be 0.6 m; wherein sizes of corresponding models are as follows: the interlayer spacing is 10 mm, and the distance from the topmost porous laminated plate to the lower deck is 10 mm; under a survival load condition, a distance from bottom surfaces of the additional porous structures to a calm water line is 11 m, so that interaction with waves is basically avoided, and a hydrodynamic performance of the platform in normal operation will not be affected; a thickness value of the additional porous structures on the columns is 10% of a width of the columns, and comprehensively considering a height and thickness distribution of typical run-up water jets along the columns, wherein 10% of the width of the columns of the platform model is 1.825 m; as for a four-column gravity-type platform, a typical thickness of wave run-up water flows along surfaces of the columns close to the lower deck is about 1 m-1.5 m; and under the comprehensive considerations, the thickness of the additional porous structures on the columns is set to 1.5 m, and a corresponding model value is 25 mm; and S4: determining parameters of the porous laminated plates, wherein the determination includes comprehensively considering a machining process of the additional structure models, material strength and porosity, setting a dimension of pores to 5.5 mm*3.5 mm, wherein an edge spacing between the pores in a width direction is 2 mm; and in a thickness direction, the pores are arrayed in four rows, an edge spacing between the pores is 2.2 mm, and an overall porosity is about 41.1%.

* * * * *